US011311082B2

(12) United States Patent
Ortega

(10) Patent No.: US 11,311,082 B2
(45) Date of Patent: Apr. 26, 2022

(54) TOOL ORGANIZER FOR RETAINING A TOOL HAVING A THROUGH-HOLE AND A TOOL ASSEMBLY THEREOF

(71) Applicant: Austin Tommy Ortega, Stockton, CA (US)

(72) Inventor: Austin Tommy Ortega, Stockton, CA (US)

(73) Assignee: Austin Tommy Ortega, Stockton, CA (US)

( * ) Notice: Subject to any disclaimer, the term of this patent is extended or adjusted under 35 U.S.C. 154(b) by 0 days.

(21) Appl. No.: 17/004,548

(22) Filed: Aug. 27, 2020

(65) Prior Publication Data

US 2022/0061471 A1 Mar. 3, 2022

(51) Int. Cl.
*A44B 15/00* (2006.01)

(52) U.S. Cl.
CPC ..... *A44B 15/002* (2013.01); *A44D 2200/10* (2013.01); *A44D 2211/00* (2013.01); *A45F 2200/0558* (2013.01)

(58) Field of Classification Search
CPC ..... A44B 15/002; A44D 2200/10; A44D 2211/00; A45F 2200/0558; A45F 5/02; A45C 11/324; Y10T 24/1319; Y10T 24/31; Y10T 24/1498; Y10T 24/34
See application file for complete search history.

(56) References Cited

U.S. PATENT DOCUMENTS 1,211,296 A * 1/1917 Davis ..... A44B 5/00 24/102 E
2,326,693 A * 8/1943 Sindler ..... A44B 15/00 70/457
2,395,235 A * 2/1946 Schmidhuber ..... A44B 15/00 70/457
2,611,260 A * 9/1952 Pontin ..... A45C 11/324 70/456 R
2,720,777 A * 10/1955 Kocsi ..... A45C 11/324 70/456 R
2,729,965 A * 1/1956 Kurlian ..... A45C 11/324 70/456 R
3,011,537 A * 12/1961 Castro ..... A45C 11/32 206/37.8

(Continued)

OTHER PUBLICATIONS

Bellroy, Key Cover, product information pages, Bellroy Pty Ltd, 2020 (admitted prior art).

*Primary Examiner* — Victor D Batson
*Assistant Examiner* — Matthew J Sullivan
(74) *Attorney, Agent, or Firm* — Burris Law, PLLC

(57) ABSTRACT

A tool organizer is configured to hold one or more tool having a through-hole. The tool organizer includes at least two braces and a resilient band. Each brace includes a neck and defines at least two slots provided on either side of the neck. The resilient band is configured to attachably couple to and detachably couple from the braces. Each of the at least two slots defines a retainment portion and a channel portion extending from the retainment portion to define an opening along an outer perimeter of the brace. A dimension of the channel portion is less than that of the retainment portion, and a section of the retainment portion is defined by the neck. The resilient band is attachable to wrap around the necks of the at least two braces and extend through the retainment portions of the slots and between the at least two braces.

16 Claims, 5 Drawing Sheets

(56) References Cited

U.S. PATENT DOCUMENTS

| | | | | |
|---|---|---|---|---|
| 3,315,504 | A * | 4/1967 | Billings, Jr. | A45C 11/32 70/408 |
| 3,751,769 | A * | 8/1973 | Reiner | A45D 8/34 24/300 |
| 5,207,082 | A * | 5/1993 | LeMaitre | E05B 19/00 70/408 |
| 7,327,943 | B2 * | 2/2008 | Vo | G02B 6/4475 385/134 |
| 2011/0016937 | A1 | 1/2011 | Downes | |
| 2011/0302970 | A1 | 12/2011 | Amron | |
| 2017/0055662 | A1 * | 3/2017 | Taylor | A45D 24/10 |

* cited by examiner

TOOL ORGANIZER FOR RETAINING A TOOL HAVING A THROUGH-HOLE AND A TOOL ASSEMBLY THEREOF

FIELD

The present disclosure relates to a tool organizer for fastening and organizing tools having a through-hole.

BACKGROUND

The statements in this section merely provide background information related to the present disclosure and may not constitute prior art.

Tools having a through-hole can include knifes, hand tools, keys, and even, volumetric measurement devices like measuring cups. To organize and retain multiple tools together, a single or multipiece fastener may be employed. Common fastening components include rings, screws, bolts, rods, key rings, and/or straps, among other.

SUMMARY

This section provides a general summary of the disclosure and is not a comprehensive disclosure of its full scope or all of its features.

In one form, the present disclosure is directed to a tool organizer for holding one or more tools having a through-hole. The tool organizer includes at least two braces and a a resilient band. Each of the at least two braces includes a neck and defines at least two slots provided on either side of the neck. The resilient band is configured to attachably couple to and detachably couple from the at least two braces. Each of the at least two slots defines a retainment portion and a channel portion extending from the retainment portion to define an opening along an outer perimeter of the brace. A dimension of the channel portion is less than that of the retainment portion, and a section of the retainment portion is defined by the neck. The resilient band is attachable to wrap around the necks of the at least two braces and extend through the retainment portions of the slots and between the at least two braces.

In one form, the each of the at least two braces has an upper section and a lower section. The upper section and the lower section are connected via the neck and define a contour of the slots.

In another form, the at least two braces have a disc-shaped body, a rectangular-shaped body, or a combination thereof.

In yet another form, at least one dimension of each of the two braces is greater than a dimension of the through-hole of the tool.

In one form, the resilient band includes elastic properties to elastically deform in response to a force exerted on the resilient band and to create tension between the at least two braces.

In another form, each of the at least two braces includes two slots, and the two slots extend radially from the neck in opposite directions from one each other.

In yet another form, each of the at least two braces defines two slots and has a divider extending from the neck. The two slots extend parallel to one another on either side of the neck with the divider provided between the two slots.

In one form, the channel portion is configured to have a transition fit with the resilient band and the retainment portion is configured to have a clearance fit with the resilient band.

In another form, tool organizer further includes two resilient bands. Each of the at least two braces have an elongated body with two opposed end portions and a support portion extending between the end portions. Each of the end portions includes the neck and defines the at least two slots provided on either side of the neck, and the two resilient bands are attachable to wrap around the necks of the end portions.

In one form, the present disclosure is directed toward a tool assembly that includes at least one tool defining a through-hole, and a tool organizer configured to compressably retain the at least one tool. The tool organizer includes at least two braces, where each of the at least two braces include a neck and defines at least two slots provided on either side of the neck. The tool organizer further includes a resilient band configured to attachably couple to and detachably couple from the at least two braces. Each of the slots defines a retainment portion and a channel portion extending from the retainment portion to define an opening along an outer perimeter of the brace. A dimension of the channel portion is less than that of the retainment portion, and a section of the retainment portion is defined by the neck. The resilient band is attachable to wrap around the necks of the at least two braces and extend through the retainment portions of the slots and between the at least two braces. The at least one tool is disposable between the at least two braces with the resilient band extending through the through-hole of the at least one tool.

In one form, the tool organizer includes at least one closed brace defining two holes, where the resilient band extends through the two holes.

In another form, the at least one tool includes a knife, a scissor, a ruler, a bottle opener, a corkscrew opener, a volumetric measuring device, a hand tool, or a combination thereof.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1B:
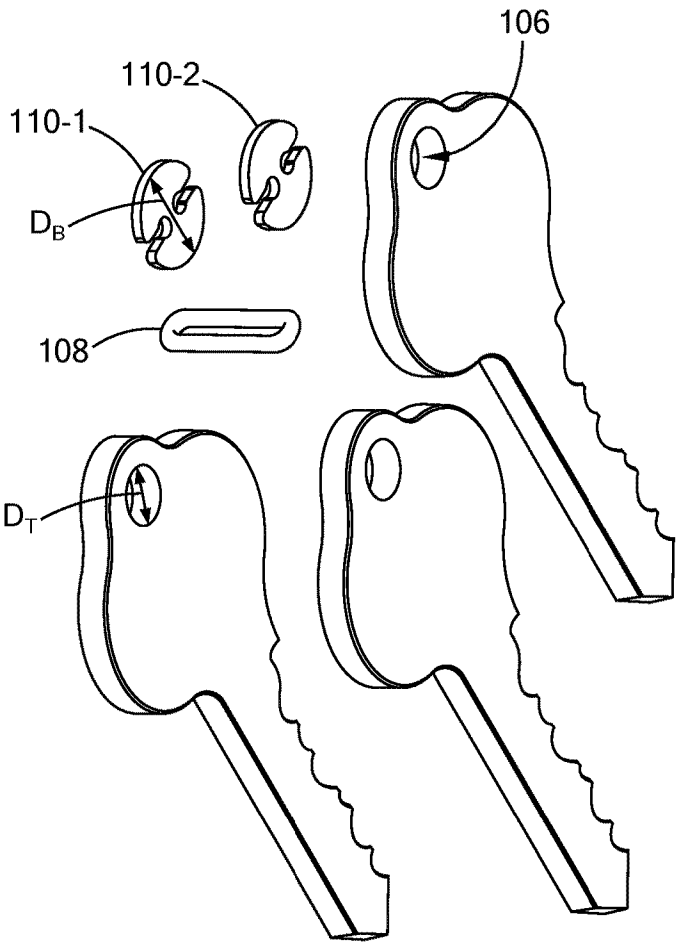
FIG. 1B is an exploded view of the tool assembly of FIG. 1A.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1A:
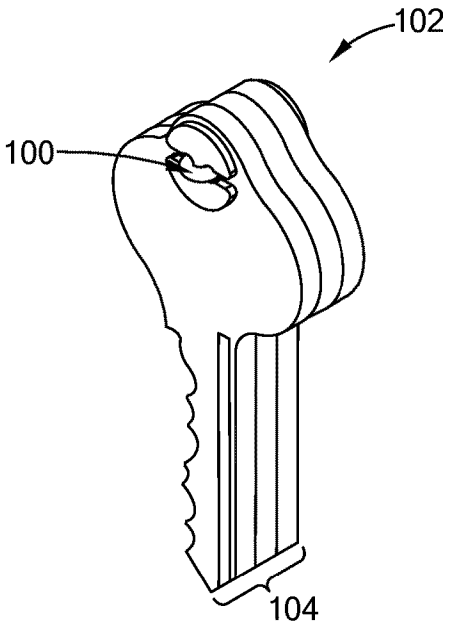
FIG. 1A is perspective view of a tool assembly having a tool organizer in accordance with the present disclosure.
Figure 1C:
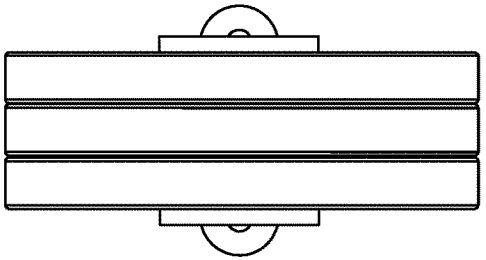
FIG. 1C is a top view of the tool assembly of FIG. 1A.

Referring to FIGS. 1A and 1B, a tool organizer 100 of the present disclosure is employed for a tool assembly 102 to compressably and resiliently retain one or more tools 104 having a through-hole 106. In one form, the tools 104 are provided as multiple keys, where each key includes the through-hole 106. While the tools 104 are provided as keys, the tool organizer 100 may be employed with other types of tools having a through-hole 106 such as, but not limited to knife, scissors, ruler, bottle opener, corkscrew opener, a volumetric measuring device (e.g., measuring cup or measuring spoon), and/or hand tool (screwdriver, wrench, plier, file, wire cutter, tweezer, among others). In addition, the multiple tools may be a combination of different types of tools and should not be limited to the same tool. For example, a file, a wrench, a key, and a ruler may form the tools retained by the tool organizer 100.

In one form, the tool organizer 100 includes a resilient band 108 configured to extend through the through-hole 106 of the tools 104 and a first brace 110-1 and a second brace 110-2 (collectively "braces 100"). In one form, the braces 110 have a planar body such as a disc-shaped body. The braces 110 are configured to hold the resilient band 108 and constrict movement of the tools 104. In one form, to inhibit the braces 110 from fitting through the through-hole 106, at least one dimension of the braces 110 is greater than a diameter of the through-hole 106 of the tools 104. For example, with the disc-shaped body, the diameter of the braces 110 ($D_B$) is greater than the diameter of the through-hole 106 of the tool ($D_T$). In one form, the braces 110 is formed of a rigid material that does not elastically deform. For example, the braces 110 may be made of metal, a high-density polyethylene, or other suitable stiff material.

Figure 2B:
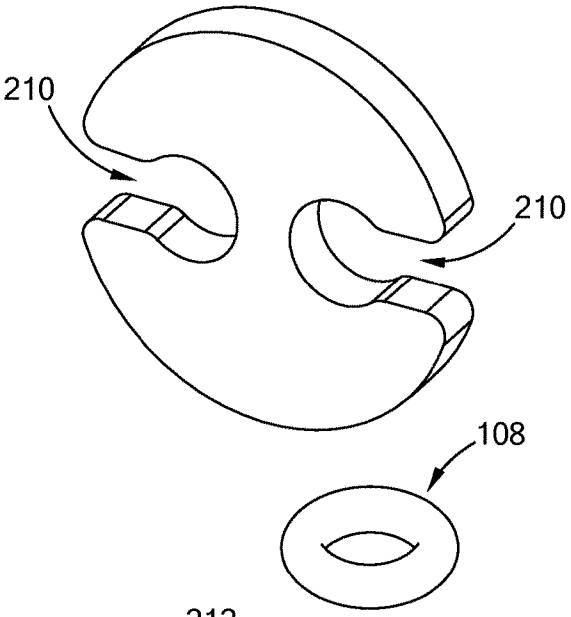
FIG. 2B is an exploded view of the tool assembly of FIG. 2A.
Figure 2B:
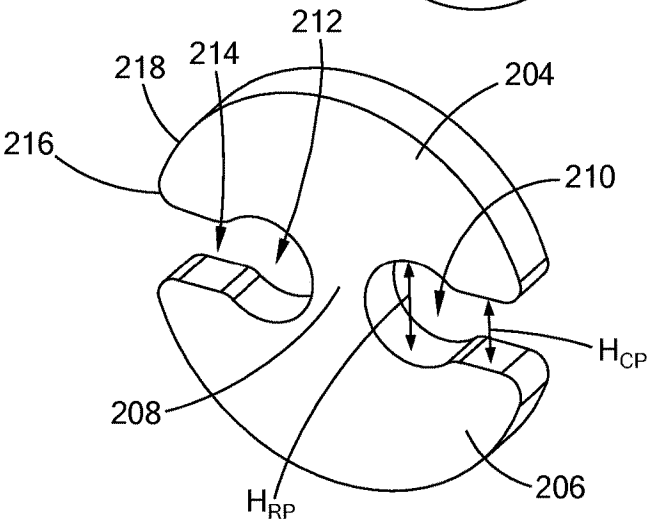
Figure 2A:
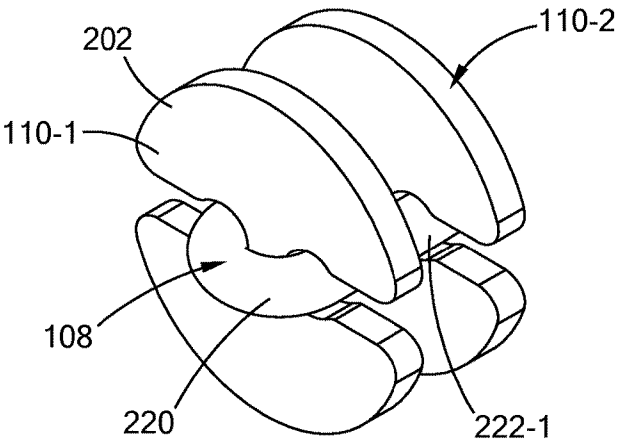
FIG. 2A is perspective view of the tool assembly of FIG. 1A.
Figure 2C:
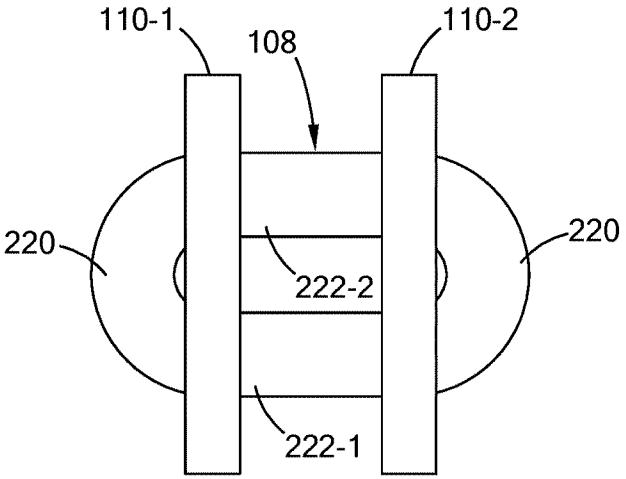
FIG. 2C is a top view of the tool assembly of FIG. 2A.

Referring to FIGS. 2A, 2B, and 2C, in one form, each of the braces 110 includes a body 202 that has an upper section 204, a lower section 206, and a neck 208 connecting the upper section 204 and the lower section 206. The body 202 defines at least two slots 210 provided on either side of the neck 208 and extending between the upper section 204 and the lower section 206 (i.e., the upper section 204 and the lower section 206 define the contour of the slots 210). Each slot 210 defines a retainment portion 212 and a channel portion 214 extending from the retainment portion 212 to define an opening 216 at an outer perimeter 218 of the body 202.

In one form, the channel portion 214 is configured to have a transition fit with the resilient band 108 while the retainment portion 212 is configured to have a clearance fit with the resilient band 108. More particularly, a height of the channel portion 214 ($H_{CP}$) defined between a surface of the upper section 204 and a surface of the lower section 206 of the body 202 is less than a height of the retainment portion 212 ($H_{RP}$) defined between the surface of the upper section 204 and the surface of the lower section 206. With this configuration, the resilient band 108 may translate through the channel portion 214 with a small amount of force applied to the resilient band 108 and may move within the retainment portion 212. The translation fit and the varying height of the slot 210 further inhibits the resilient band 108 from slipping out of the slot 210 and disconnecting from the braces 110. In one form, the contour of the slots 210 are the same. That is, the brace 110 is symmetrical about a central axis through the neck 208. In another form, the contour of the slots may be different from one another. For example, the height of the channel portion of a first slot may be different from that of a second slot.

Figure 3A:
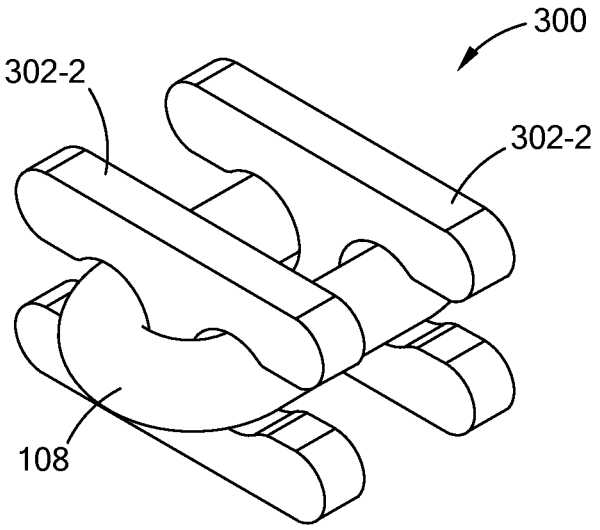
FIGS. 3A and 3B are a perspective view and an exploded view of a second form of a tool assembly in accordance with the present disclosure, respectively.

While the braces 110 are provided as having a disc-shaped body, the braces 110 may be configured in other suitable shapes. For example, with reference to FIGS. 3A and 3B, a tool organizer 300 includes a first brace 302-1 and a second brace 302-2 (collectively braces 302) that have a rectangular-shaped body with slots 304 extending from either side of a neck 306. The slots 304 are configured in a similar manner as slots 210 of the braces 110, and thus, details regarding the slots 304 are omitted herein. Similar to the braces 110, at least one dimension of the braces 302 is greater than a diameter or in other words, a dimension of the through-hole 106 of the tools 104. In one form, at least one dimension of the braces 302 is smaller than the through-hole 106 to allow the tool organizer 300 to be threaded through the tools while maintaining both braces 302 on the resilient band. Other suitable shapes may also be employed for the braces and should not be limited to the shapes provided herein. In addition, the braces employed by the tool organizer may have different shapes. For example, a tool organizer may employ at least one disc-shaped brace and at least one rectangular shaped brace.

While only two braces 110 are illustrated, more than two braces 110 may be provided. Additional braces 110 may be referred to as intermediate braces 110 that are disposed between two braces to support the tools 104 and/or form dividers between adjacent tools 104.

Figure 3B:
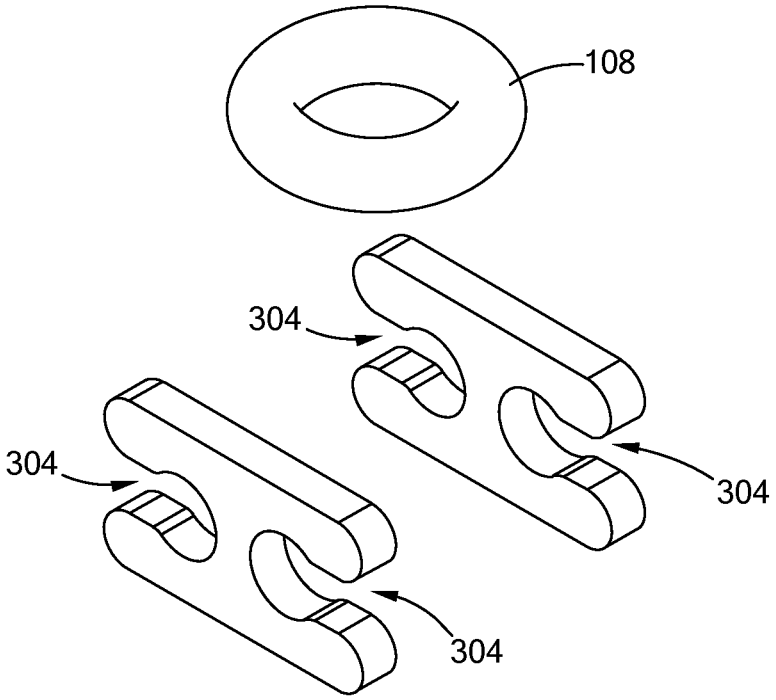

In one form, the resilient band 108 has elastic properties to stretch and extend about the braces 110 while creating tension between the braces 110 and further, the tools 104. For example, FIGS. 2B and 3B illustrate the resilient band 108 in a non-deformed state and at least FIGS. 1B and 2C illustrates the resilient band 108 in an elastically deformed state in which force is exerted on the resilient band 108 to extend between the braces 110 and the tools 104. The material and/or size of the resilient band 108 is selectable based on various characteristics such as but not limited to: geometric configuration of the braces 110 (e.g., dimension of the slots); minimum and/or maximum number of tools 104 to be supported by the tool organizer 100; the amount of force to be exerted by a user to remove and attach the resilient band 108; and/or the amount of translational movement of the braces 110 and/or tools 104 along the resilient band 108. For example, in one application, with no tools 104 provided, the resilient band 108 is selected to permit translational movement between the braces 110 without elastic deformation and with one or more tools 104, the resilient band 108 generates a compressive force or tension to reduce or inhibit translational movement between the braces 110 and the tools 104. In another example application, the resilient band 108 is selected to reduce or inhibit movement between the braces 110 when no tools 104 are disposed between. And through elastic deformation, the resilient band 108 provides flexibility for attaching and detaching the resilient band 108 to add/remove tools 104 between the braces 110.

With continuing reference to FIGS. 2A and 2C in an assembled state of the tool organizer 100, the first brace 110-1 and the second brace 110-2 are opposed to one another to form the ends of the tool organizer 100. The resilient band 108 is disposed around the necks 208 of the braces 110 and extend through the retainment portion 212 of the slots 210. More particularly, in one form, the resilient band 108 elastically deforms to define two anchor portions 220 provided about the necks 208 and a pair of parallel elongated members 222 (shown as members 222-1 and 222-2 in figures) that extend from the anchor portions 220. The elongated members 222 extend on either side of the necks 208 and through the retainment portions 212 of the braces 110.

With additional reference to FIG. 1A, the tool organizer 100 of the present disclosure provides a compact retaining device for holding one or more tools 104 together while allowing movement between the tools 104 by elastically deforming the resilient band 108. More particularly, in an assembled state of the tool assembly 102, the one or more tools 104 are disposed between the braces 110 and hang from the resilient band 108. Specifically, from the braces 110, the elongated members 222 of the resilient band 108 extend through the through-holes 106 of the tools 104 such that the tools 104 hang from the resilient band 108 between the braces 110 and are rotatable about the parallel members. With the elastic deformability of the resilient band 108, the tool organizer 100 compresses the tools 104 together while allowing rotatable and translational movement of the tools 104 about and along the elongated members 222 for the user to access a particular tool. Like tool organizer 100, the tool organizer 300 operates in similar manner.

Figure 4:
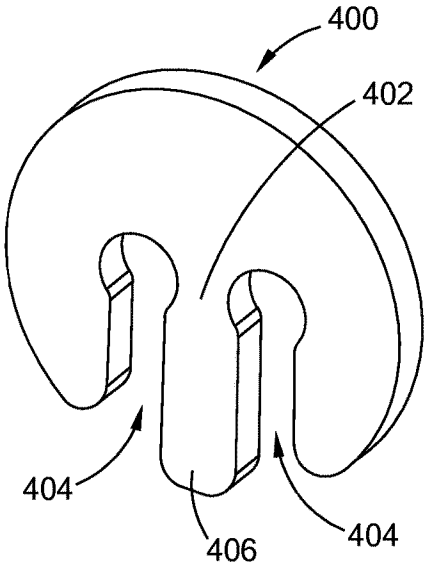
FIG. 4 is a perspective view of a third form of a brace for the tool organizer in accordance with the present disclosure.

In the braces 110 and 302, the slots 210 and 304 extend radially outwards in opposite directions from the neck 208 and 306, respectively. Referring to FIG. 4, in another form, a tool organizer may include a brace 400 that includes a neck 402 and two slots 404 extending parallel to one another on either side of the neck 402. In this configuration, a divider 406 is provided between the two slots 404. The slots 404 are configured in a similar manner as slots 210 of the braces 110, and thus, details regarding the slots 404 are omitted herein. Similar to the brace 110, at least one dimension of the brace 400 is greater than a diameter/dimension of the through-hole 106 of the tools 104. A tool organizer of the present disclosure may employ the brace 400 in a similar manner as that of braces 110 and 302.

In one form, some tools may have an elongated shape that may be retained within the tool organizer using elongated braces. Specifically, with reference to FIG. 5A, a tool organizer may include an elongated brace 500 having an elongated body 502 with two opposed end portions 504A and 504B (end portions 504) and a support portion 506 extending between the end portions 504. Each of the end portions 504 includes a neck 508 and defines at least two slots 510 provided on either side of the neck 508. The slots 510 are similar to that of slots 210, and define a retainment portion 512 and a channel portion 514 extending from the retainment portion 512 to define an opening 516 at an outer perimeter 518 of the body 502.

Similar to the braces 110, 302, and 400, the resilient band 108 is configured to attachably couple to and detachably couple from the end portions 504 of the elongated brace 500. More particularly, when assembled, the tool organizer includes at least of two of the elongated braces 500 and at least two resilient bands 108 for the end portions 504. The resilient band 108 is attachable to wrap around the necks 508 of the elongated braces 500 and extend through the retainment portions 512 of the slots 510 and between the elongated braces 500.

The length of the elongated brace 500 is determined based on the length of the tool being held. More particularly, in one form, the length of the elongated brace is set to be longer than the tool to be held if the only one end of the tool is to have the through-hole. Thus, with the tools disposed between two elongated braces 500, one resilient band 108 may extend through the through-hole of the tool, while the other resilient band extends through a gap defined between the two braces 500. In another form, if the tool includes through-holes on both ends, the elongated braces 500 are adapted such that the resilient band 108 extends through respective through-holes. Accordingly, the elongated brace 500 may provide structural support and control of the tool throughout the length of the tool.

Figure 5B:
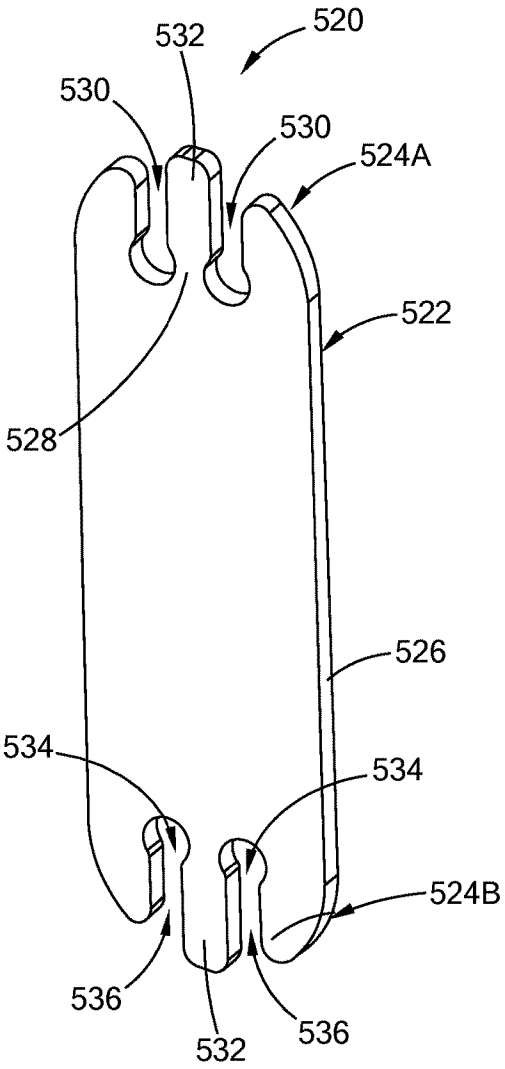
FIGS. 5A and 5B are perspectives view of a fourth form of a brace for the tool organizer in accordance with the present disclosure.
Figure 5A:
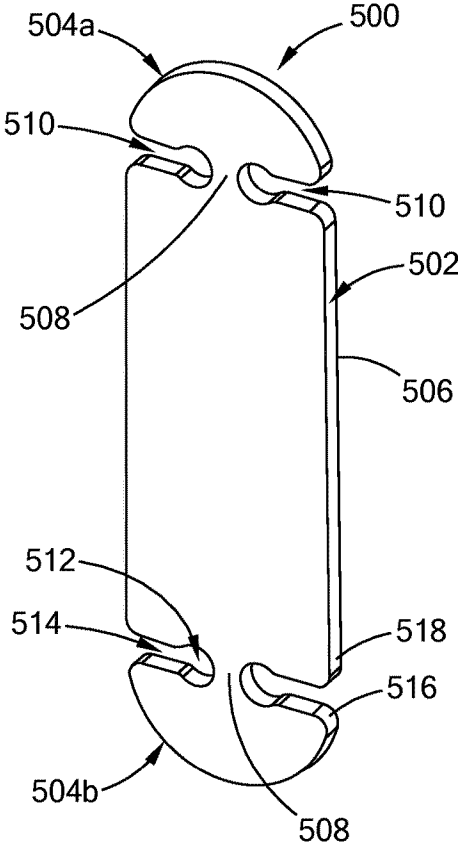

While the slots 510 of the elongated brace 500 is configured in a similar manner as that of braces 110 and 302, an elongated brace may have a similar configuration as that of brace 400. For example, FIG. 5B illustrates an elongated brace 520 having an elongated body 522 with two opposed end portions 524A and 524B (end portions 524) and a support portion 526 extending between the end portions 524. Each of the end portions 524 includes a neck 528 and defines at least two slots 530 provided on either side of the neck 528. Here, the slots 530 extend parallel to one another on either side of the neck 528, thereby forming a divider 532 between the two slots 530. The slots 530 are configured in similar manner as that of slots 510 and 210 to have a retainment portion 534 and a channel portion 536, and thus, details regarding the slots 530 are omitted herein. The elongated brace 520 is employed as part of a tool organizer to organize tools in a similar manner as that of elongated brace 500, and thus, details regarding assembly of the tool organizer having the elongated brace 520 is omitted herein.

While the end portions 504 of the elongated brace 500 are the same and the end portions 524 of the elongated brace 520 are the same, an elongated brace may have different style end portions. For example, one end portion of an elongated brace may be like end portion 504 and the other end portion of the elongated brace may be like the end portion 524.

In addition, a tool organizer may employ at least one elongated brace 500 and one elongated brace 520. That is, the elongated braces do not have to be same.

Figure 6:
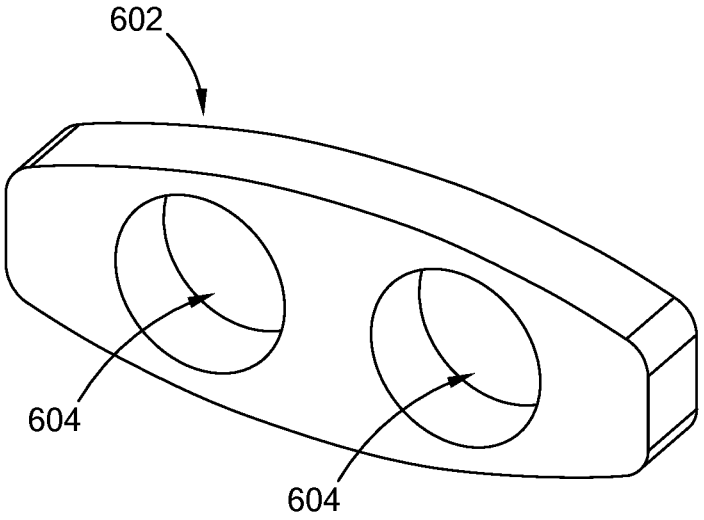
FIG. 6 is a perspective view of a closed brace for the tool organizer.

With reference to FIG. 6, a tool organizer may include a closed brace 602 having two holes 604 for a resilient band. In one form, the brace 602 has at least one dimension that is greater than a dimension of the through-hole of the tools and at least one dimension that is smaller than a dimension of the through-hole to allow the brace 302 having the resilient band to be threaded through the through-hole. The brace 602 may be used with the other braces described herein. In another form, the tool organizer may include only include two or more of the braces 602.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A tool organizer for holding one or more tool having a through-hole, the tool organizer comprising:

at least two braces, wherein each of the at least two braces includes a neck and defines at least two slots provided on either side of the neck; and a resilient band configured to attachably couple to and detachably couple from the at least two braces, wherein:

each of the at least two slots defines a retainment portion and a channel portion extending from the retainment portion to define an opening along an outer perimeter of the brace, a dimension of the channel portion is less than that of the retainment portion, and a section of the retainment portion is defined by the neck, the resilient band is attachable to wrap around the necks of the at least two braces and extend through the retainment portions of the slots and between the at least two braces, each of the at least two braces defines two slots and has a divider extending from the neck, and the two slots extend parallel to one another on either side of the neck with the divider provided between the two slots.

2. The tool organizer of claim 1, wherein each of the at least two braces has an upper section and a lower section, the upper section and the lower section are connected via the neck and define a contour of the slots.

3. The tool organizer of claim 1, wherein the at least two braces have a disc-shaped body, a rectangular-shaped body, or a combination thereof.

4. The tool organizer of claim 1, wherein at least one dimension of each of the two braces is greater than a dimension of the through-hole of the tool.

5. The tool organizer of claim 1, wherein the resilient band includes elastic properties to elastically deform in response to a force exerted on the resilient band and to create tension between the at least two braces.

6. The tool organizer of claim 1, wherein the channel portion is configured to have a transition fit with the resilient band and the retainment portion is configured to have a clearance fit with the resilient band.

7. The tool organizer of claim 1 further comprising two resilient bands, wherein:

each of the at least two braces have an elongated body with two opposed end portions and a support portion extending between the end portions, each of the end portions includes the neck and defines the at least two slots provided on either side of the neck, and the two resilient bands are attachable to wrap around the necks of the end portions.

8. A tool assembly comprising:

at least one tool defining a through-hole:

a tool organizer configured to compressably retain the at least one tool, wherein the tool organizer includes:

at least two braces, wherein each of the at least two braces include a neck and defines at least two slots provided on either side of the neck, and a resilient band configured to attachably couple to and detachably couple from the at least two braces, wherein:

each of the slots defines a retainment portion and a channel portion extending from the retainment portion to define an opening along an outer perimeter of the brace, a dimension of the channel portion is less than that of the retainment portion, and a section of the retainment portion is defined by the neck, and the resilient band is attachable to wrap around the necks of the at least two braces and extend through the retainment portions of the slots and between the at least two braces, further wherein:

the at least one tool is disposable between the at least two braces with the resilient band extending through the through-hole of the at least one tool, each of the at least two braces defines two slots and has a divider extending from the neck, and the two slots extend parallel to one another on either side of the neck with the divider provided between the two slots.

9. The tool assembly of claim 8, wherein each of the at least two braces has an upper section and a lower section, the upper section and the lower section are connected via the neck and define a contour of the slots.

10. The tool assembly of claim 8, wherein the at least two braces have a disc-shaped body, a rectangular-shaped body, or a combination thereof.

11. The tool assembly of claim 8, wherein the tool organizer includes at least one closed brace defining two holes, wherein the resilient band extends through the two holes.

12. The tool assembly of claim 8, wherein the resilient band includes elastic properties to elastically deform in response to a force exerted on the resilient band and to create tension between the at least two braces and the at least one tool.

13. The tool assembly of claim 8, wherein the channel portion is configured to have a transition fit with the resilient band and the retainment portion is configured to have a clearance fit with the resilient band.

14. The tool assembly of claim 8, wherein the at least one tool includes a knife, a scissor, a ruler, a bottle opener, a corkscrew opener, a volumetric measuring device, a hand tool, or a combination thereof.

15. The tool assembly of claim 8, wherein:

each of the at least two braces have an elongated body with two opposed end portions and a support portion extending between the end portions, and each of the end portions includes the neck and defines the at least two slots provided on either side of the neck.

16. The tool assembly of claim 15, wherein the tool organizer includes two resilient bands, wherein the two resilient bands are attachable to wrap around the necks of the end portions.

* * * * *